US005240405A

United States Patent [19]

Schubach et al.

[11] Patent Number: 5,240,405

[45] Date of Patent: Aug. 31, 1993

[54] WASTE OIL HEATER SYSTEM

[76] Inventors: Gary Schubach, 4805 S. Farr Rd., Spokane, Wash. 99206; Frank Schubach, S. 911 Wright Blvd., Liberty Lake, Wash. 99019

[21] Appl. No.: 912,233

[22] Filed: Jul. 6, 1992

[51] Int. Cl.[5] ..... F23N 5/00

[52] U.S. Cl. ..... 431/62; 110/348; 431/12

[58] Field of Search ..... 431/62, 63, 5, 18, 3, 431/2, 11, 12; 110/238, 260, 186, 185, 348; 126/93

[56] References Cited

U.S. PATENT DOCUMENTS

| | | | |
|---|---|---|---|
| 1,453,662 | 5/1923 | Dunham | 431/11 X |
| 4,013,396 | 3/1977 | Tenney | 431/11 |
| 4,303,055 | 12/1981 | Fixler | 126/93 |
| 4,308,854 | 1/1982 | Kroll | 126/93 |
| 4,385,621 | 5/1983 | Kroll | 126/93 |
| 4,392,820 | 7/1983 | Niederholtmeyer | 431/11 X |
| 4,797,089 | 1/1989 | Schubach et al. | 431/208 |
| 4,877,395 | 10/1989 | Schubach et al. | 431/208 |

*Primary Examiner*—Larry Jones
*Attorney, Agent, or Firm*—Mark W. Hendrickson

[57] ABSTRACT

An improved system to control the flame, efficiency and flow rate in a waste oil feed system and burner. The system controller comprises a positive displacement waste oil pump, a variable speed motor connected to and driving said pump, and a motor speed control which control the speed of the motor, the speed of the pump and, consequently, the flow rate of the waste oil. Controlling the flow rate of the waste oil precisely allows the more efficient atomization and combustion of waste oils with different combustion and flow properties.

3 Claims, 1 Drawing Sheet

WASTE OIL HEATER SYSTEM

1. FIELD OF THE INVENTION

This invention generally relates to an improved apparatus for the control and burning of waste oil in a heater assembly.

2. BACKGROUND OF THE INVENTION

It has been well known for years to utilize waste oil in burner and heater systems. For a good description of the problems unique to the preheating and burning of waste oil, see U.S. Pat. No. 4,877,395 issued to Schubach on Oct. 31, 1989. In the typical waste oil burner system, the waste oil is contained in and pumped from a reservoir, and thereafter delivered to a nozzle. The aperture in the nozzle atomizes the waste oil in a spray configuration. The atomized waste oil is then ignited to produce the flame and consequent heat.

There are two known means to force the waste oil through the atomization nozzle. The predominant means is an air driven feed system in which pressurized air is introduced to the flow of waste oil at or near the atomization nozzle, thereby providing the force to push the oil through the aperture of the nozzle. The pressurized air further mixes with the waste oil, thereby creating different patterns of atomization and different flame characteristics, as compared to a system with no air introduced. The second means to force the waste oil through the nozzle is a hydraulic-driven waste oil combustion system wherein the force which pushes the waste oil through the aperture of the atomization nozzle is created by the oil pump pushing the waste oil to the atomization nozzle (see U.S. Pat. No. 4,877,395 issued to Schubach on Oct. 31, 1989).

In the hydraulic-based closed system, on startup, the initial flow of the waste oil causes the waste oil to fill the system piping and thereafter create back pressure based upon the flow. The back pressure is related to the force created by the rate of the flow and dependent, to a limited extent, on the size of the aperture in the atomization nozzle.

The force created by the flow, the closed system, and the size of the aperture in the atomization nozzle, result in waste oil being forced through the aperture and atomized in a given pattern. Systems such as that described in U.S. Pat. No. 4,877,395 issued to Schubach, utilize a needle flow valve (Item 9, FIG. 1, Column 7, lines 60–65, therein to control and regulate the rate of flow through the pipe and between the waste oil pump and the atomization nozzle.

Since there are no applicable, practical limits in the size of the positive displacement pumps typically used, there has likewise not been any practical or other limits on the vertical or horizontal distance the waste oil pump can be located from the atomization nozzle. It has been an industry practice for many years to locate the waste oil pump at the oil tank.

The systems using a positive displacement pump at a constant flow rate have heretofore been unable to sufficiently obtain the optimum efficiency because of their inability to sufficiently control the flow rate. These systems have further not had sufficiently easy or precise adjustability to be efficiently adaptable to oils of different types, weights and other combustion properties.

Existing systems are not indefinitely adjustable to achieve different desired flow rates for fuels of different properties. For instance, when light fuels are used, they typically have a lower energy content per volume and therefore the user receives a reduced heat output for a given volume or flow rate. Further compounding the problems associated with the non-adjustability of other systems is the fact that the flow rates of lighter fuels through the positive displacement pumps is reduced due to gear slippage, thus further reducing the heat output of the heater. Our system's adjustability solves these problems to an extent never before achieved in the art.

In many use situations, the type and combustion properties of the oil used varies greatly and regularly and a fixed, non-adjustable oil pump speed is therefore not the most efficient.

A compound problem occurs when fixed, non-adjustable oil pumps are used with oils of different properties and viscosities, namely: the lighter weight oils produce less heat per given volume and flow rate and their use therefore reduces the heat output of the system; and there is a reduced flow rate of lighter weight oils through the oil pump due to greater gear slippage and other factors. The combination of the lower heat content and actual lower fuel flow rate make the systems currently in use much less efficient and with a substantially lower heat output for lighter fuel oils.

Our invention provides a sufficiently easy and adjustable control means to react to the specific oil being used thereby solving some of the problems associated with other systems. When a different fuel oil is used, the flow rate of the system can easily be increased to maintain relatively constant system heat output by simply adjusting the motor speed and hence the oil pump speed and flow rate generated thereby.

Our invention solves this problem and obtains greater efficiency by greatly increasing the control over the flow rate of the positive displacement pump. Our system uniquely accomplishes this by driving a positive displacement pump with a variable speed motor attached to and controlled by a motor speed control device.

In our system, the burner operator can fine tune and adjust to the optimum flame and efficiency by making adjustments to the motor speed control, thereby changing the speed of the variable speed motor which changes the speed of the positive displacement pump and consequently changing the flow rate of the waste oil.

The flow rate created by the positive displacement pump, in conjunction with the size and shape of the aperture of the atomization nozzle and the air pressure utilized, determines the spray pattern of the waste oil exiting the atomization nozzle and fuel consumption rate in any given system.

SUMMARY OF THE INVENTION

Our invention generally provides an improved system to control the flame pattern and efficiency of a waste oil burner or heater by precisely controlling the flow rate of the waste oil. The flow rate of the waste oil is controlled through the use of a motor speed controller connected to and controlling the variable speed motor which is connected to and which drives the positive displacement waste oil pump.

The control system provided by this invention can be used in conjunction with many different waste oil burner systems and preheat assemblies, such as that provided in U.S. Pat. No. 4,877,395 issued to Schubach.

An object of our invention is to achieve a more efficient waste oil burner. This object is accomplished more precisely controlling the flame pattern through effective and precise control over the flow rate of the waste oil using the motor speed controller connected to the variable speed motor driving the positive displacement pump.

It is a further object of this invention to provide a more efficient waste oil burner system control means that can quickly and precisely be adjusted waste oils of different types, weights and other combustion properties are utilized. This object is also accomplished through close control over and easy adjustability over the flow rate of the waste oil, as set forth more fully herein.

The forenamed combination accomplishes a further object of the invention to greatly reduce the flame impingement, inefficient burning, and incomplete combustion occurring in the waste oil burner industry.

It is a further object of this invention to accomplish the above through inexpensive means by utilizing known components so that expensive and complicated flow control devices need not be used, which this invention accomplishes.

Other objects, features, and advantages of this invention will appear from the specification, claims, and accompanying drawings which form a part hereof. In carrying out the objects of this invention, it is to be understood that its essential features are susceptible to change in design and structural arrangement, with only one practical, and preferred embodiment being illustrated in the accompanying drawings, as required.

BRIEF DESCRIPTION OF THE DRAWINGS

In the accompanying drawings, which form a part hereof.

DETAILED DESCRIPTION

Figure 1:
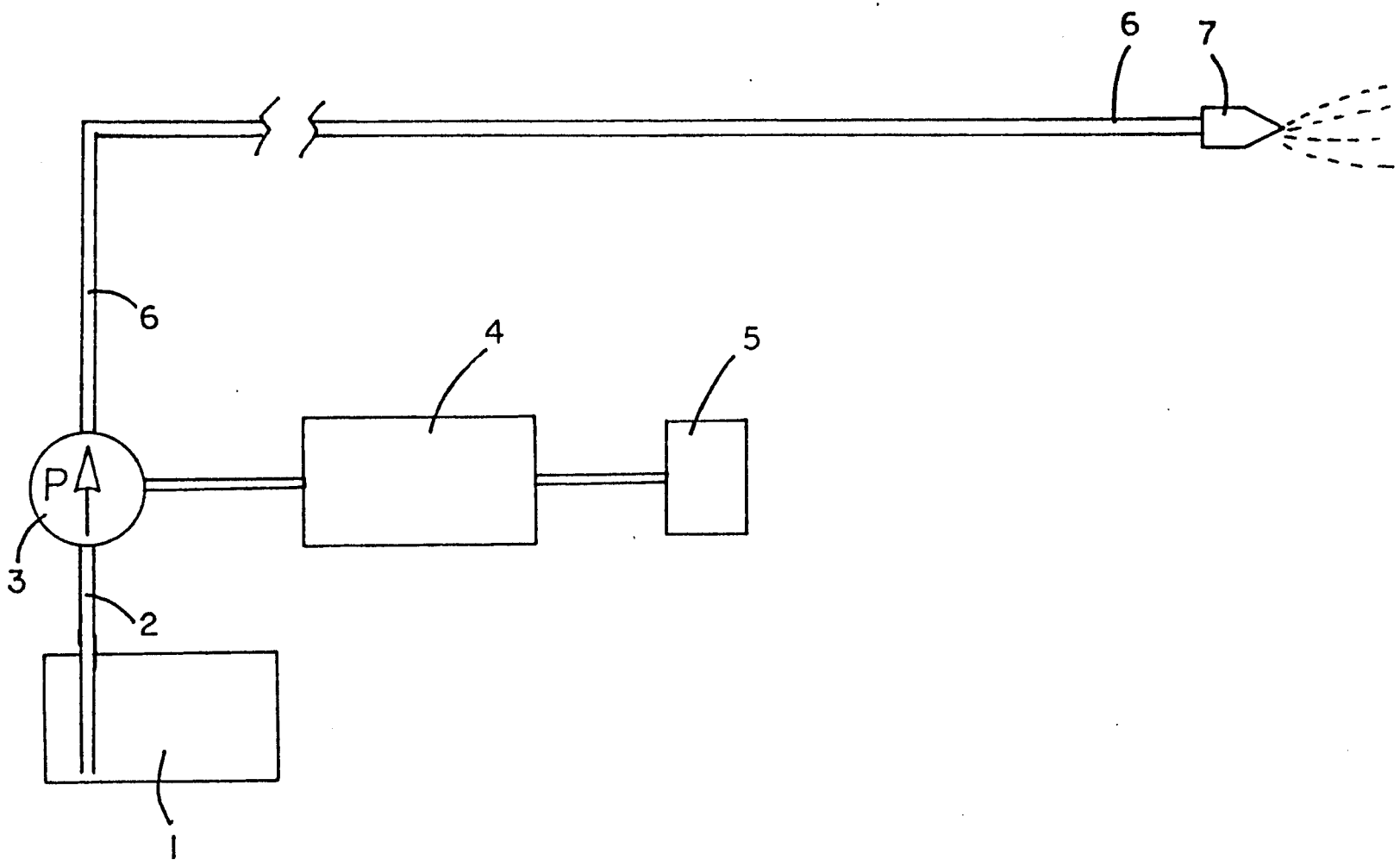
FIG. 1 is a schematic view of the improved waste oil fuel delivery and control system according to the present invention.

Our invention generally provides an apparatus for the system control and preheat of waste oil in a waste oil feed system and burner, which can be used in cooperation with a conventional space heater. More particularly, our invention provides a positive displacemente waste oil pump driven by a variable speed motor, which is precisely and adjustably controlled by a motor speed controller, preferably an electronic motor speed controller.

Many of the fastening, connection and wiring means, and other components utilized in this invention are widely known and used in the field of the invention described, and their exact nature or type is not necessary for an understanding and use of the invention by a person skilled in the art or science, and they will not therefore be discussed in significant detail.

Further, the various components shown or described herein for any specific application of this invention can be varied or altered as anticipated by this invention. This invention comprises a unique combination of elements, each element of which can be accomplished by one of several different means or variations for a specific application of this invention. The practice of a specific application of any element may already be widely known or used in the art or by persons skilled in the art or science, and each will not therefore be discussed in significant detail.

FIG. 1 shows the source of waste oil to be an oil storage tank 1. A piping means 2 is submersed in the waste oil in the oil storage tank 1 and connected to a positive displacement pump 3.

The positive displacement pump 3 draws or induces the flow of waste oil from the oil storage tank 1 and then pumps the oil to the atomization nozzle 7. There can be any one of several different types of atomization nozzles used, with differing apertures therein, all of which are readily available and used in the industry.

There can be numerous preheat and other control devices between the positive displacement pump 3 and the nozzle 7 within the contemplation of this invention. If the system is air driven, the pressurized air is added to the oil supply line at or near the nozzle 7, thereby supplying the atomizing pressure.

The positive displacement pump 3 can be any of a number of different types of pumps, such as the Model SV2 oil burner fuel unit manufactured by Combu, Inc., of Woonsacket, Rhode, Island, or that manufactured by SunTek, Model A2RA-7736. The positive displacement pump 3 includes a standard, built in pressure relief means including a pressure gauge port and a pressure regulator adjustment screw.

Connected to and driving the positive displacement pump 3 is a motor means 4. The motor means 4 can be any one of a number of different types, with the preferred embodiment utilizing a parallel shaft gear motor, such as Model VW80DC by Fasco, Von Weise Gear Motors.

Connected to and controlling the speed of the motor means 4 is a motor speed control 5, the preferred embodiment being a DC motor speed control (SCR Phase-Angle), Model VWE-PH-MO15 by Fasco, Von Weise Gear Motors. The motor speed control 5 can likewise be any one of a number of different types.

The oil supply line outlet from the positive displacement pump 3 is piping 6 which is communicably connected to the nozzle 7. Depending on the system with which this invention is used, there may be a preheat assembly or other system components.

While the preferred embodiment for the invention has been described in detail, those familiar with the art to which this invention relates will recognize various alternative designs and embodiments for carrying out the invention, as defined by the claims which follow.

The invention claimed is:

1. A waste oil burner feed and control apparatus for improved control of the output flame of a waste oil burner which atomizes waste oil to facilitate combustion, by precisely and adjustably controlling the flow rate of the waste oil being combusted, comprising:

(a) a source of oil;

(b) an oil supply line which receives oil from the source of oil;

(c) a positive displacement oil pump in constant communication with the oil supply line, which induces the flow of oil from the source of oil through the oil supply line and into itself, and which then pumps the oil through piping and to a nozzle for atomization;

(d) a system control means which comprises a variable speed motor connected to and driving said positive displacement oil pump, and an adjustable motor speed control means which is communicably connected to said variable speed motor; such that when the motor speed control means is adjusted, the speed of the variable speed motor, the positive displacement pump and the flow rate of the waste oil are thereby all altered, which consequently alters the combustion rate and efficiency of the waste oil burner.

2. A waste oil control and burner apparatus as recited in claim 1, wherein the nozzle is an air driven atomization nozzle.

3. A waste oil control and burner apparatus as recited in claim 1, wherein the nozzle is a hydraulic driven atomization nozzle, wherein the waste oil is atomized by the force created by the constant flow rate of waste oil produced by the positive displacement pump.

* * * * *

US005240405B1

(12) REEXAMINATION CERTIFICATE (4478th)

United States Patent

Schubach et al.

(10) Number: US 5,240,405 C1

(45) Certificate Issued: Nov. 6, 2001

(54) WASTE OIL HEATER SYSTEM

(75) Inventors: Gary Schubach, 4805 S. Farr Rd., Spokane, WA (US) 99206; Frank Schubach, S. 911 Wright Blvd., Liberty Lake, WA (US) 99019

(73) Assignees: Gary Schubach, Spokane; Frank Schubach, Liberty Lake, both of WA (US)

Reexamination Request:
No. 90/005,635, Feb. 10, 2000

Reexamination Certificate for:

| | |
|---|---|
| Patent No.: | **5,240,405** |
| Issued: | **Aug. 31, 1993** |
| Appl. No.: | **07/912,233** |
| Filed: | **Jul. 6, 1992** |

(51) Int. Cl.[7] ..... F23N 5/00

(52) U.S. Cl. ..... 431/62; 110/348; 431/12

(58) Field of Search ..... 431/11, 12, 89, 431/90, 207, 208, 28; 126/93

(56) References Cited

U.S. PATENT DOCUMENTS

| | | | | |
|---|---|---|---|---|
| Re. 34,826 | * | 1/1995 | Specht | 431/208 |
| 2,000,580 | * | 5/1935 | Carruthers | 431/12 |
| 3,718,102 | * | 2/1973 | Hemsath et al. | 431/284 |
| 3,876,363 | * | 4/1975 | La Haye et al. | 431/11 |
| 3,885,904 | * | 5/1975 | Feng | 431/11 |
| 4,280,469 | * | 7/1981 | Ganoung | 123/568 |
| 4,308,854 | * | 1/1982 | Kroll | 126/93 |
| 4,351,316 | * | 9/1982 | Kroll | 126/93 |
| 4,353,712 | * | 10/1982 | Marion et al. | 431/6 |
| 4,797,089 | * | 1/1989 | Schubach et al. | 431/28 |
| 5,058,512 | * | 10/1991 | Specht | 431/208 |
| 5,080,579 | * | 1/1992 | Specht | 431/11 |

OTHER PUBLICATIONS

Clean Burn Literature, Precision Control Products, Series 8000 instructions, AMF, Cuno, Oct. 1977.*

* cited by examiner

*Primary Examiner*—Carl D. Price

(57) ABSTRACT

An improved system to control the flame, efficiency and flow rate in a waste oil feed system and burner. The system controller comprises a positive displacement waste oil pump, a variable speed motor connected to and driving said pump, and a motor speed control which control the speed of the motor, the speed of the pump and, consequently, the flow rate of the waste oil. Controlling the flow rate of the waste oil precisely allows the more efficient atomization and combustion of waste oils with different combustion and flow properties.

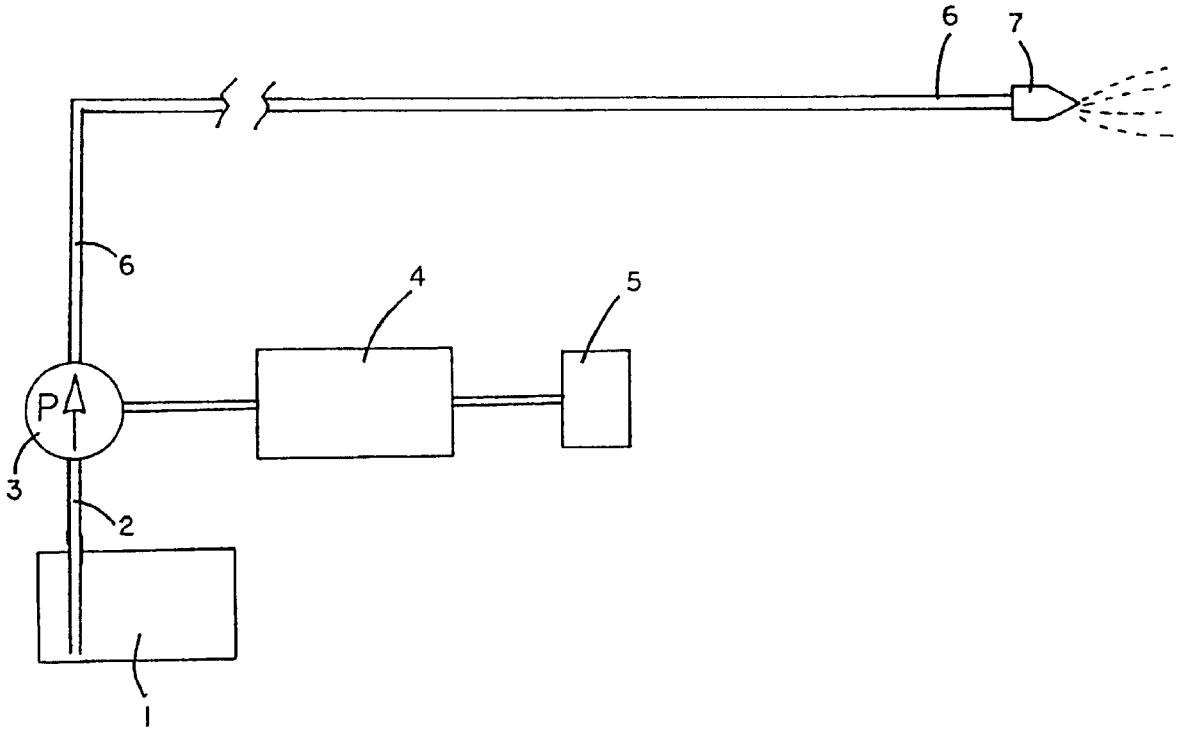

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–3 are cancelled.

* * * * *